US006152630A

United States Patent [19]

Scarton et al.

[11] Patent Number: 6,152,630

[45] Date of Patent: Nov. 28, 2000

[54] PRINTER WITH TWO WORKING POSITIONS

[75] Inventors: Gianrico Scarton, Ivrea; Attilio De Ambrogio, Cigliano, both of Italy

[73] Assignee: Olivetti Lexikon, S.p.A., Ivrea, Italy

[21] Appl. No.: 09/393,181

[22] Filed: Sep. 10, 1999

[30] Foreign Application Priority Data

Sep. 14, 1998 [IT] Italy ..... TO98A0778

[51] Int. Cl.[7] ..... B41J 13/10

[52] U.S. Cl. ..... 400/642; 400/693

[58] Field of Search ..... 400/642, 647, 400/625, 624, 647.1, 691, 692, 693, 694

[56] References Cited

U.S. PATENT DOCUMENTS

| | | | |
|---|---|---|---|
| 4,946,298 | 8/1990 | Oka et al. | 400/605 |
| 5,297,018 | 3/1994 | Kashimura | 400/693 |
| 5,387,043 | 2/1995 | Fujioka et al. | 400/625 |
| 5,454,555 | 10/1995 | Kiyohara et al. | 271/9 |
| 5,538,237 | 7/1996 | Miyauchi | 400/691 |
| 5,967,682 | 10/1999 | Tanahashi | 400/691 |

FOREIGN PATENT DOCUMENTS

| | | | |
|---|---|---|---|
| 4104970 | 8/1992 | Germany | 400/642 |
| 2248226 | 4/1992 | United Kingdom | 400/647.1 |

*Primary Examiner*—John S. Hilten
*Assistant Examiner*—Anthony H. Nguyen
*Attorney, Agent, or Firm*—Banner & Witcoff, Ltd.

[57] ABSTRACT

An ink jet printer having selectively two distinct working positions (P1, P2), respectively a vertical working position (P1) and a horizontal working position (P2), comprising an external casing provided with a first and a second side, both flat, with a common edge and reciprocally inclined at an obtuse angle; a feeding tray for accommodating at the entrance the sheets to be fed to the printer; and a collecting tray, arranged to the front of the feeding tray, for collecting the sheets at the outlet after they have been printed. In the vertical working position (P1), the printer sits on a horizontal plane on its first side, and has the feeding and collecting trays directed upwardly; whereas, in the horizontal working position (P2), the printer sits on the horizontal plane on its second side, and has the feeding and collecting trays disposed horizontally to the operator. The printer has the advantage that it can be disposed differently to the user, depending on the latter's preferences, and can also be easily arranged for use on the horizontal plane, taking into account the amount of space actually available.

11 Claims, 5 Drawing Sheets

PRINTER WITH TWO WORKING POSITIONS

FIELD OF THE INVENTION

This invention relates to a printer, particularly though not exclusively of the ink jet type, suitable for working selectively in two distinct positions for performing the printer's typical functions, such as accommodating a plurality of sheets at an entrance, printing them, and finally of providing them at an outlet to a user after they have been printed.

BACKGROUND OF THE INVENTION

Printers have today become a product that cannot be done without, not only for office work but also for the normal requirements of a home, with the result that the printers are now called on to satisfy ever newer and more pressing requirements in terms of functionality and of possibilities of use.

In particular, one requirement especially perceived by users is that of disposing of printers which, besides being capable of performing good quality printing, are also versatile and readily adaptable, and for example possess the ability to print on sheets having different formats, and/or on particular types of printing media, such as an envelope, without having to remove the previously loaded sheets from the printer on account of this.

Another widely perceived requirement is that of also disposing of printers which are very easy to use, and which in particular are capable of adapting to the preferences of the different users as regards the method of loading the sheets therein, from the top or horizontally, and also the method of removing them after printing.

Yet another demand voiced more and more frequently by users is that of disposing of printers that are not very cumbersome and are easy to locate in any environment, working or other.

A printer intended to satisfy, at least partially, the requirements and demands outlined briefly above is represented by the ink jet printer described in the European patent application No. EP 0 732 216 A1, and adapted to be set, when in use, on a plane in two distinct working positions, respectively horizontal and vertical, at 90 degrees to each other.

This printer, when it is used in its horizontal position, is fed with the sheets through a first feeding device incorporated in the printer itself. The printer, when used in its vertical position, is fed with the sheets from a second feeding device, forming an additional external module, coupled with the printer.

In this way, the user can choose between two different positions or arrangements in which to set the printer on the support plane, taking into consideration in particular the amount of space available.

In addition the user has the possibility of loading the sheets into the printer and of receiving them from the latter after printing in different directions, depending on which position was chosen for it on the support plane.

In particular, if the printer is set in the horizontal working position, the sheets are arranged by the user directed upwardly on a lectern, from where they may be conveyed along a U-shape path through the printer, so as to present themselves to the user, after printing, still arranged vertically; whereas, if the printer is in the vertical working position, the sheets are disposed in the vertical direction in the additional module, and follow a substantially linear path thereafter, so as to be received by the user after printing in the horizontal direction.

Unfortunately this printer, though provided with many appreciable features, most notable of which the ability to work in two distinct positions, has the disadvantage of being quite complex to use, typically requiring an additional module in order to function in the two different working positions, and also of not fully satisfying the requirements and demands stated above.

Another printer whose declared object is also that of satisfying the requirements outlined earlier, and which is provided with the ability to function in different positions, is known from the U.S. Pat. No. 5,312,196. This printer comprises a combination of a printing unit, an automatic sheet feeder, and a support base on which the printing unit and the sheet feeder are hinged on a common axis. The printing unit and the feeder can be rotated reciprocally and with respect to the base in order to have the printer assume different positions and orientations, depending on the user's preferences and requirements. The printing unit can also work alone, separate from the sheet feeder and the base, where it is fed the sheets manually by the user. This printer is not without its drawbacks, and in particular it is quite complicated to set up in the relative positions and orientations.

SUMMARY OF THE INVENTION

The object of this invention is therefore that of producing a printer which is also capable of satisfying all the requirements seen above, in a simple and inexpensive way, and which, while using the already experimented concept of being suitable for working in different positions, still significantly improves the solutions known at present.

This object is attained by the printer with two working positions having the features listed in the main claim.

A further object is that of producing a printer which can easily be placed for use in any environment, working or other, and in particular having a footprint and vertical dimensions permitting it to adapt to the amount of space actually available for accommodating the printer.

BRIEF DESCRIPTION OF THE DRAWINGS

These and other characteristics, objects and advantages of this invention will be apparent from the description that follows, provided purely by way of an illustrative, non-restrictive example, and with reference to the accompanying drawings, where.

DESCRIPTION OF THE PREFERRED EMBODIMENTS OF THE INVENTION

With reference to the drawings, the printer according to the invention is generically indicated with the numeral 10 and is arranged for being selectively set on a horizontal plane 11 in a first working position P1 and in a second working position P2, called respectively vertical and horizontal, for performing in both these working positions the typical functions for which the printer 10 is intended.

Figure 1:
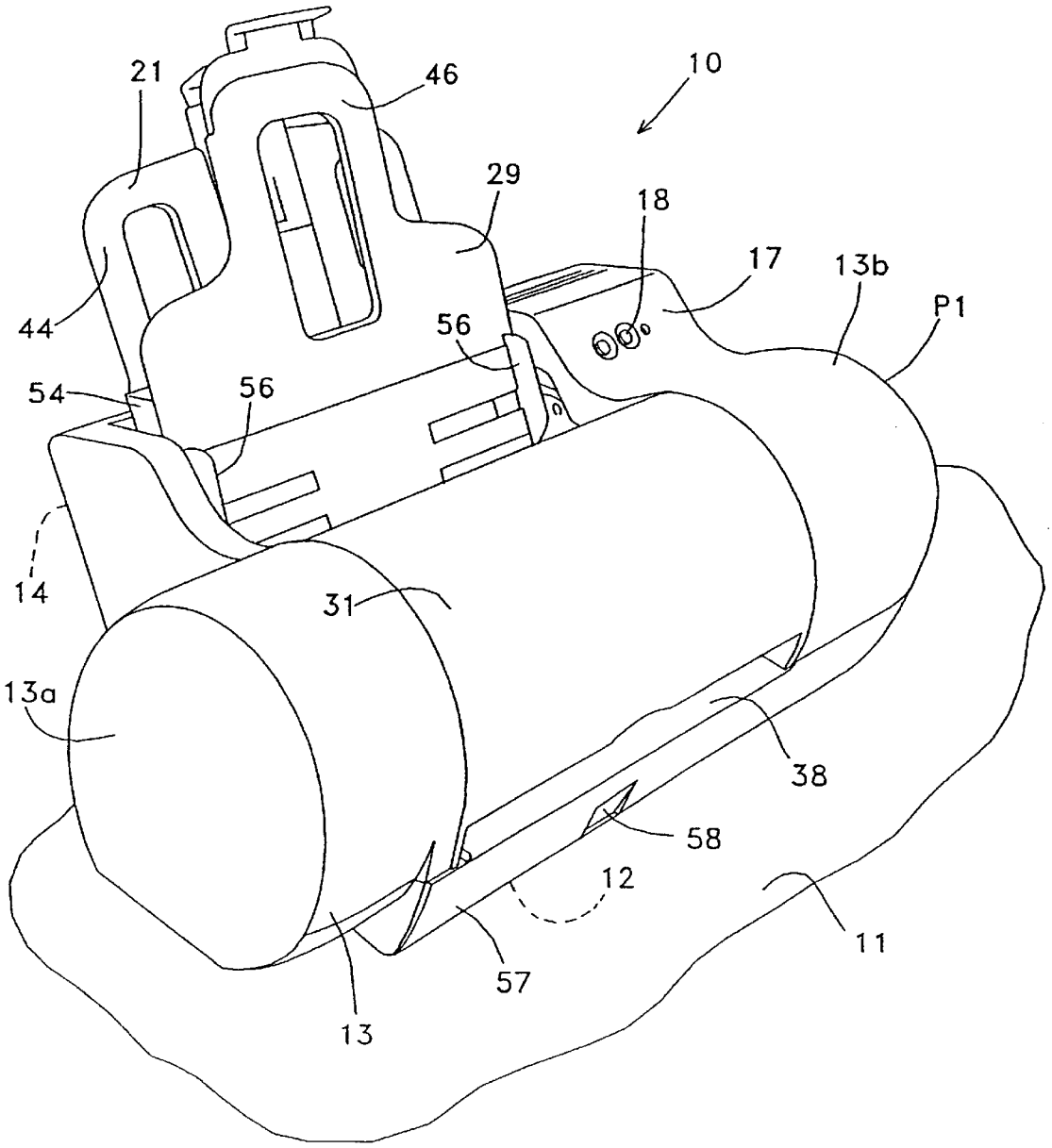
FIG. 1 is a first, perspective schematic view showing the printer according to the invention from the front, when it is set in a first, vertical working position.
Figure 2:
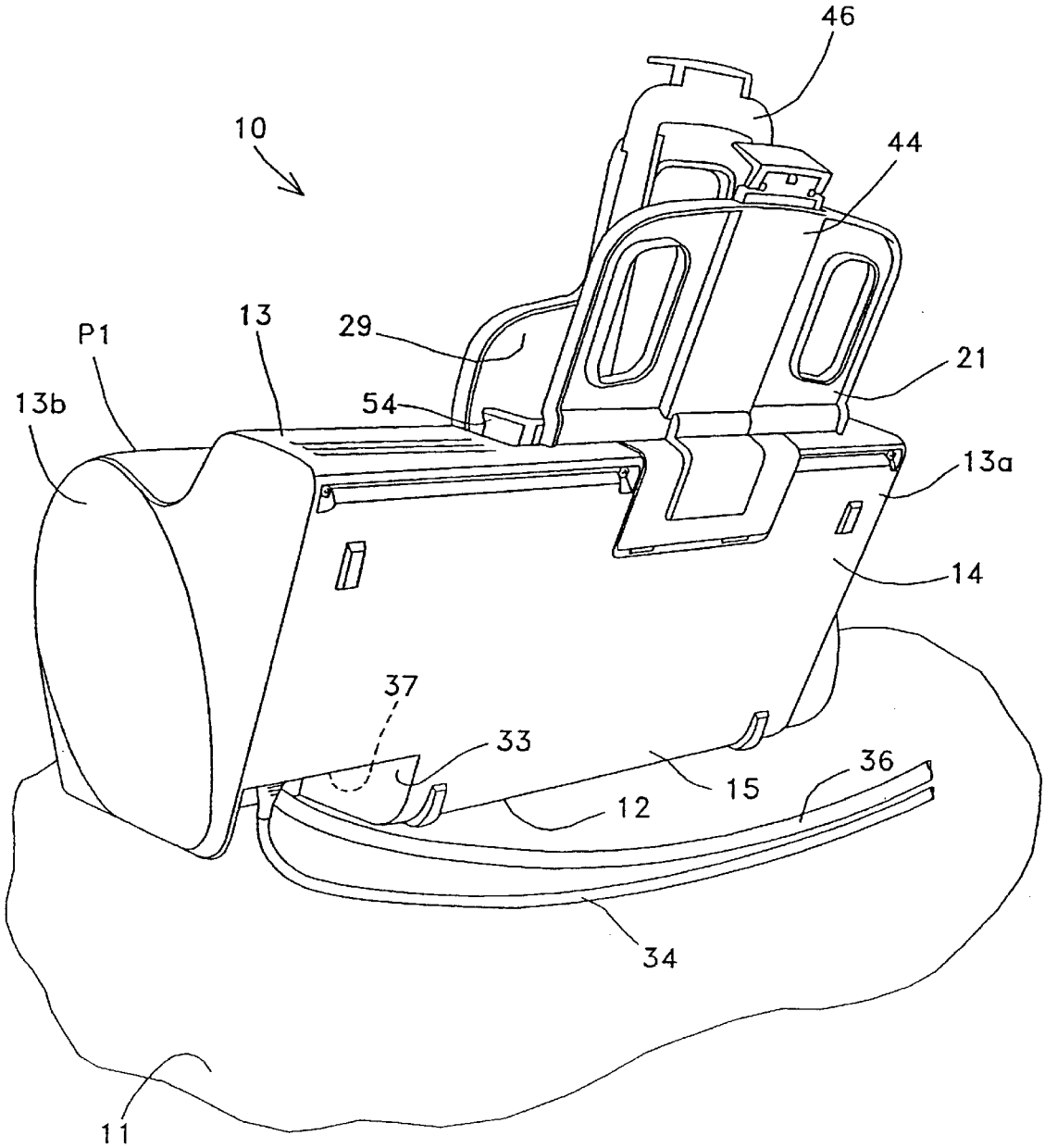
FIG. 2 is a second, perspective schematic view showing the printer of FIG. 1 from the rear, in the first, vertical working position.
Figure 6:
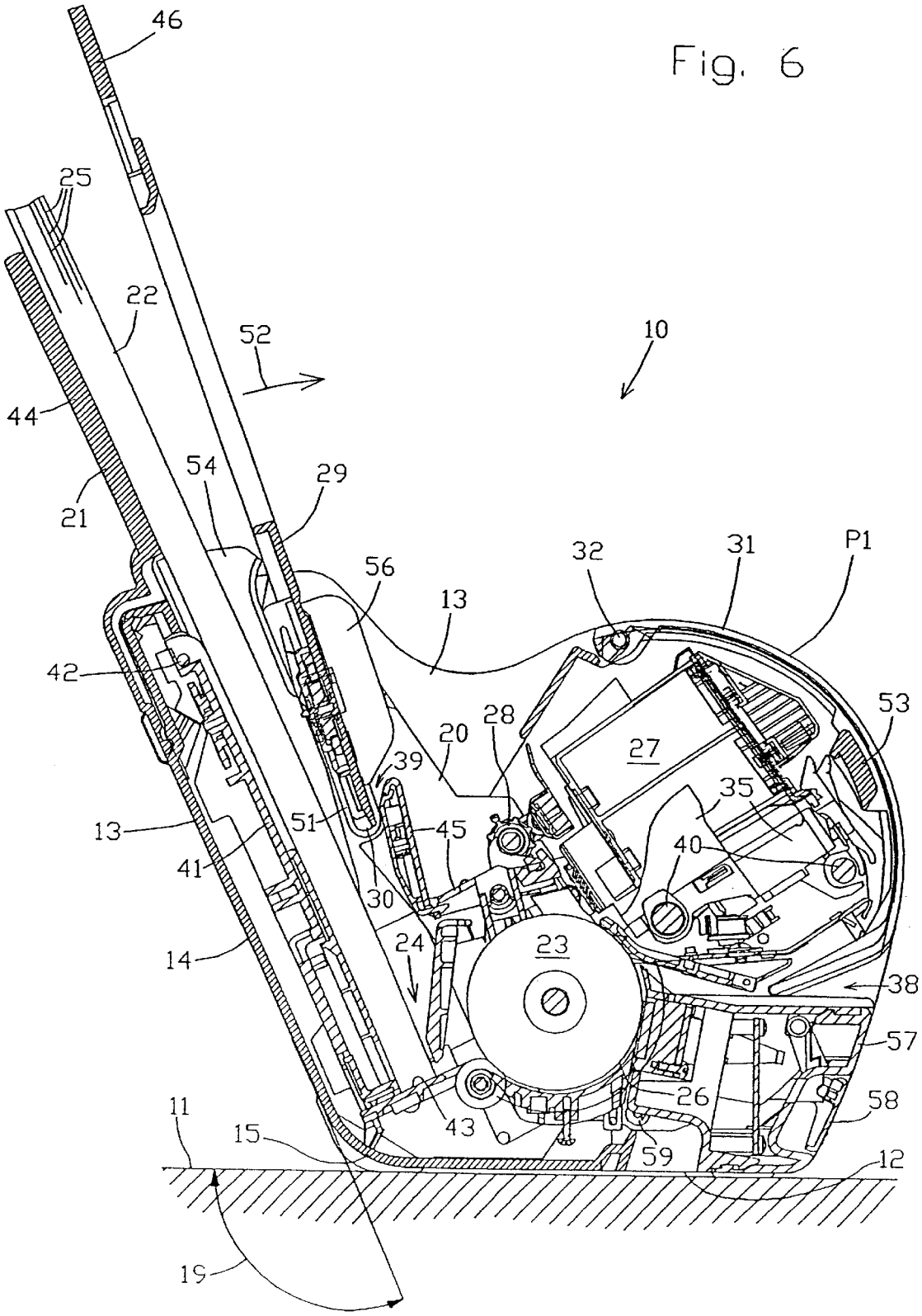
FIG. 6 is a partial and schematic section view, along a central plane, of the printer of FIG. 1 set in the vertical working position.

Initially the printer 10 will be described assuming it to be set in its vertical working position P1, as illustrated in FIGS. 1, 2 and 6. In particular the printer 10, in the vertical working position P1, sits on the plane 11 on a first, essentially flat side 12, formed by an external casing 13 of the printer 10.

In particular, FIG. 1 represents in perspective view the printer 10 roughly as it appears to its user, when it is set in the vertical working position P1.

In detail, with reference to FIG. 6, the printer 10 is, though not exclusively, of the ink jet type and comprises, in addition to the casing 13, a first internal frame 20 bearing the various mechanisms of the printer 10 and on which the casing 13 itself is attached; a feeding tray 21 for receiving at an entrance a ream 22 comprised by a plurality of sheets 25; a pick-up mechanism 24 for picking up one sheet 25 at a time from the ream 22 contained in the feeding tray 21; a feeding roller 23 suitable for rotating in order to receive, via the pick-up mechanism 24, one sheet at a time from the feeding tray 21 and for commanding the feeding of this sheet along a printing path 26 through the printer 10; a print group arranged adjacent to the path 26 and comprising an ink jet printhead 27 removably mounted on a carriage 35 suitable for moving transversally to the printing path 26 on two guides 40 of the frame 20; an ejection mechanism 28 for ejecting the sheets 25 after they have been printed by the printhead 27; and a collecting tray 29, parallel to the feeding tray 21 and which is disposed in front of the latter when seen from the work position generally adopted by the user of the printer 10, which is provided for collecting at the outlet and in succession one on top of the other the sheets 25 ejected by the ejection mechanism 28.

The casing 13 extends between two side plates 13*a* and 13*b* (FIG. 1) and defines externally, as well as the first side 12 in contact with the support plane 11 in the horizontal working position P1 of the printer 10, a second side 14, also substantially flat, which extends roughly parallel to the trays 21 and 29.

The sides 12 and 14, formed by the casing 13, have in common a rounded edge 15 (FIG. 6) which extends transversally to the side plates 13*a* and 13*b* of the printer 10, and also define an obtuse angle 19 between themselves (FIG. 6). This angle 19 may assume a value of between 95° and 160°, preferably around 125°.

The edge 15 also constitutes a zone of the casing 13 which can act as a pin, with respect to the support plane 11, about which to manually rotate the printer 10, when wishing to move it from the vertical position P1 to the horizontal position P2, or vice versa, as better described in the following. Furthermore the casing 13 has a portion, which the user sees to his right when in front of the printer 10, defining an inclined surface 17 (FIG. 1) along which a keyboard 18 is arranged, operated by the user in order to activate the printer 10.

The feeding tray 21 in turn comprises a first movable wall 41 oscillating on the frame 20 of the printer 10 about a fulcrum 42, a second wall 43 roughly perpendicular to the first wall 41, and a lectern 44 removably connected to the casing 13, so as to be removed easily from the latter according to requirements. The movable wall 41 and the lectern 44, when it is attached to the casing 13, extend alongside one another in order to support the ream 22 along practically its entire surface.

The second wall 43 has the function of supporting the ream 22 at a lower end thereof, when the printer 10 is arranged in the vertical working position P1, and accordingly the ream 22 is directed upwardly at roughly the same inclination as the side 14 not in contact with the support plane 11.

In addition, the same second wall 43 is adapted to act as an abutment for the ream 22, when the printer 10 is arranged in the horizontal working position P2 and the ream 22 is correspondingly loaded in the feeding tray 21 in the horizontal direction, as described better below.

In both the working positions P1 and P2, the wall 43 also has the function of aligning the sheets 25 comprising the ream 22 so as to arrange them correctly for feeding to the feeding roller 23.

Further, the movable wall 41 is adapted to be rotated with respect to the fulcrum 42 by the pick-up mechanism 24, in order to selectively bring an upper sheet of the ream 22 into contact with the feeding roller 23. In particular the pick-up mechanism 24 is of known characteristics and is, for example, of the type described in the Italian patent application No. TO97A000337 filed by the Applicant.

The lectern 44 defines a seat for the ream 22 delimited laterally by two sliding flaps 54, which may be adjusted by the user in order to adapt the width of the seat to the actual width of the ream 22.

In turn, the collecting tray 29 comprises a bottom 45, integral with the frame 20 of the printer 10 and arranged for supporting the sheets 25, at a lower end thereof, after they have been printed and ejected by the ejection mechanism 28, and a lectern 46 mounted, like the lectern 44, removably with respect to the casing 13 and having the purpose of supporting the sheets 25 ejected into the collecting tray 29 along a prevalent portion of their surface. In particular the lectern 46 is supported slidingly at the sides by two slides 51, of which only one is visible in FIG. 6, which are fulcrum-mounted on the casing 13 through respective fulcrums 30. In this way, the lectern 46 can be rotated slightly forward with respect to the casing 13 in the direction of the arrow 52, granting the user easier access to the feeding tray 21 for loading therein of the ream 22.

The removable connection between the lecterns 44 and 46, respectively of the feeding tray 21 and of the collecting tray 29, and the casing 13 offers considerable advantages. In this way, it is in fact possible to reduce the packaging dimensions of the printer 10, by inserting the lecterns 44 and 46 in the packaging dismounted. The user is also offered the possibility of using the printer 10 without them, whenever they are not strictly necessary, for example when the sheets 25 to be fed have a reduced surface area, and accordingly do not need to be supported by the lecterns 44 and 46.

The casing 13 also comprises a rotating lid 31, which is hinge-mounted through a fulcrum 32 on the remaining fixed part of the casing 13 and is suitable for being rotated outwardly to grant access to the internal zones of the printer 10, and in particular to the print group, for example for replacing the ink jet printhead 27 when it is finished. Further the casing 13 comprises an element 53, arranged under the lid 31, extending transversally between the side plates 13*a* and 13*b* in the zone of access to the inside of the printer 10 and which is used to endow the casing 13 with greater rigidity, and also a door 57 fulcrum-mounted on a pin 59. In particular, the door 57 is generally kept locked in a closed position flush with the outer surface of the casing 13, but it can be flipped back and outwards about the fulcrum 59, by pressing a button 58, in order to grant access to the printing path 26, for example to remove jammed sheets of paper.

Flipping the door 57 back is particularly easy, when the printer 10 is in its horizontal position P2, whereas a slight rotation upwards is required of the printer 10, when the latter is in its vertical position P1.

A recess 33 (FIG. 2), formed by the casing 13 at one end of the edge 15, houses the usual connectors for the connection of the printer 10 to the external cables needed for its operation. In particular, but not exclusively, the latter are constituted by a power cable 34 suitable for electrically powering the printer 10, and a data transmission cable 36 suitable for transmitting to the printer appropriate printing signals, coming for example from a computer.

The recess 33 extends at one end along the side 12 and at the other end along the side 14, while always remaining inside these so as not to create protrusions beyond the plane of the sides 12 and 14. The connectors for the connection of the cables 34 and 36 to the printer 10 are arranged on the same inner wall 37 of the recess 33.

The casing 13 also defines a first auxiliary slot 38 (FIG. 1), also called "by-pass", through which the operator can manually feed the printer 10 one sheet at a time, thus by-passing use of the feeding tray 21 for feeding the sheets 25.

The sheets 25 fed manually through the slot 38 gain direct access to the final stretch of the printing path 26 in the immediate vicinity of the print group and the relative printhead 27, as is shown clearly in FIG. 6, and accordingly, unlike the sheets coming from the feeding tray 21, wrap themselves about the feeding roller 23 for a brief stretch only, so that their line feed motion controlled by the feeding roller 23 is generally less precise than that of the sheets fed from the feeding tray 21. It results that the sheets fed through the slot 38 are normally used for quick printouts, but not of great precision, such as those produced when feeding the sheets from the feeding tray 21 are, on the other hand. Furthermore, the sheets inserted through the slot 38 may have a different format from that of the sheets loaded in the feeding tray 21. Yet again, the slot 38 is particularly useful for feeding special sheets made of fabric, or sheets of a certain rigidity, such as sheets of cardboard, which by their characteristics would not be capable of tolerating a feeding along a curving trajectory such as that defined by the printing path 26 about the roller 23, and which for this reason could not be fed from the tray 21.

The printer 10 is also provided with a second auxiliary or by-pass slot 39 (FIG. 6), arranged between the bottom 45 and the lectern 46 of the collecting tray 29, which also has the purpose of letting the user feed the sheets 25 manually and directly to the printer 10.

In particular the sheets 25 inserted by the user through the slot 39 are deposited on top of the ream 22, loaded in the feeding tray 21, so that these are taken by the pick-up mechanism 24 and fed along the path 26 with precedence over the sheets of the ream 22 already in the tray 21.

Therefore the slot 39, to great advantage, permits printouts of optimum quality to be obtained and extremely rapidly on special sheets, simply by introducing them through the slot 39, with the further advantage of not having to remove the sheets already in the feeding tray 21, which can thus be used later for subsequent printing jobs.

Furthermore, to facilitate the use of the slot 39, the lectern 46 is provided at the sides with sliding flaps, indicated with the numeral 56 (FIG. 1), adapted to be adjusted manually by the user in relation to the width of the sheets that will be introduced through the slot 39.

The combination deriving from disposing of the adjustable flaps 54 in the feeding tray 21, of the adjustable flaps 56 in the collecting tray 29, and of the slot 39, grants considerable advantages for use of the printer 10. In fact, in this way, it is possible to feed sheets of different widths and formats either from the feeding tray 21, or through the slot 39, without modifying the lateral adjustment already established for the flaps 54 and 56. For example, it is possible to feed an envelope directly through the slot 39, with the flaps 56 adjusted in relation to the width of the envelope, without having to change the lateral adjustment of the flaps 54 already established for a ream 22 of A4 format, or vice versa.

Figure 3:
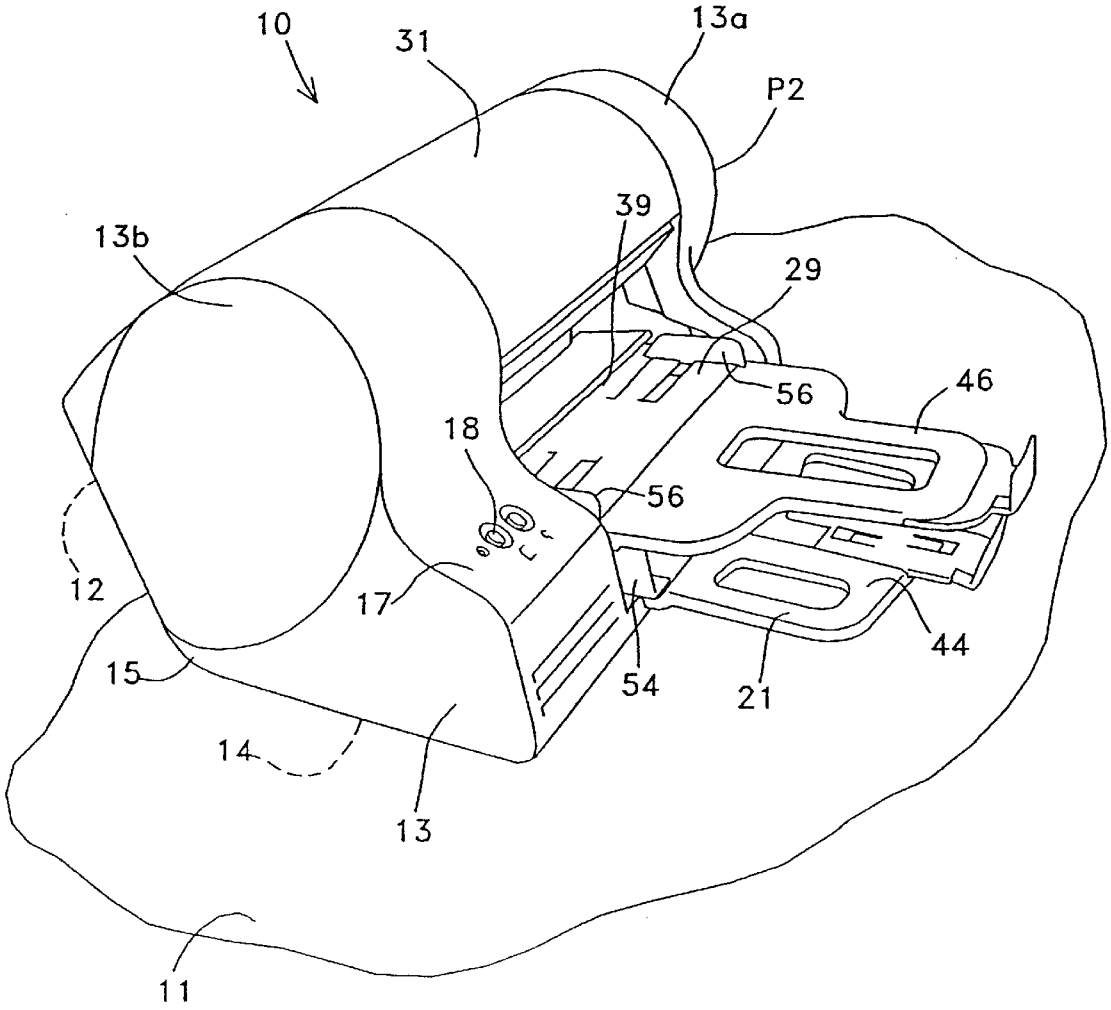
FIG. 3 is a third, perspective schematic view showing the printer of FIG. 1 from the front, when it is set in a second, horizontal working position.
Figure 4:
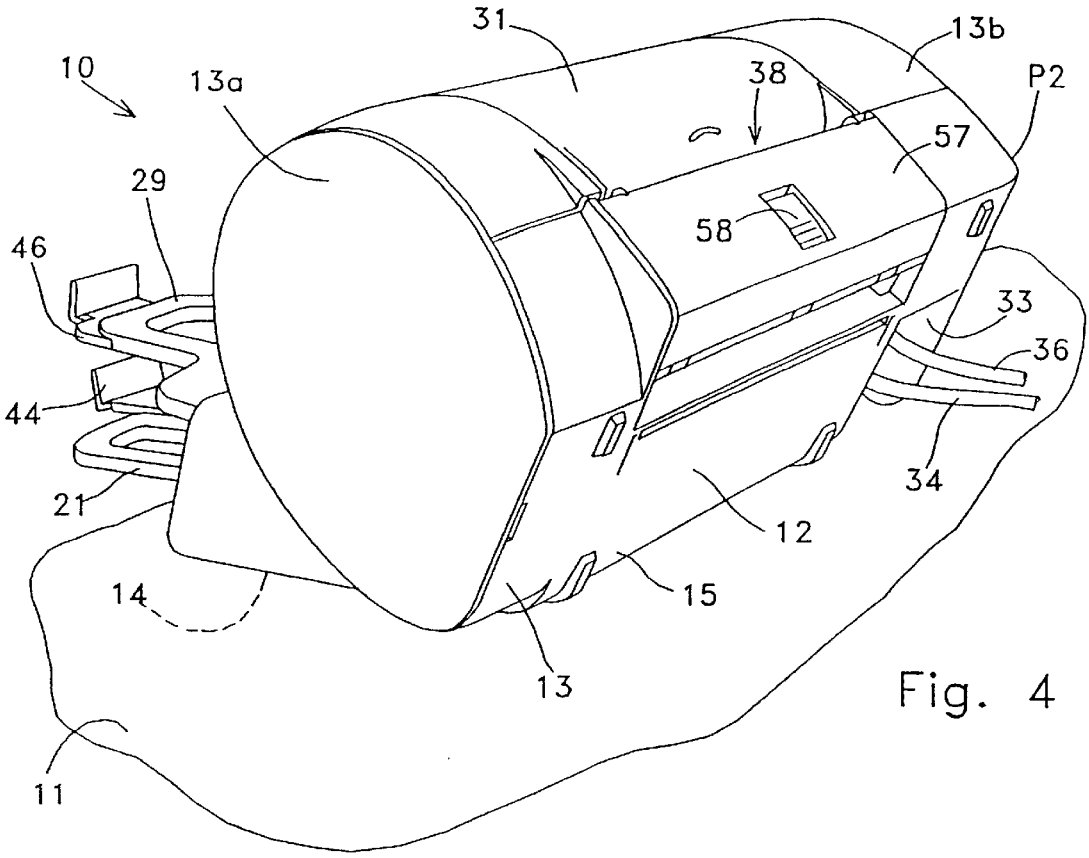
FIG. 4 is a fourth, perspective schematic view showing the printer of FIG. 3 from the rear, in the second, horizontal working position.
Figure 5:
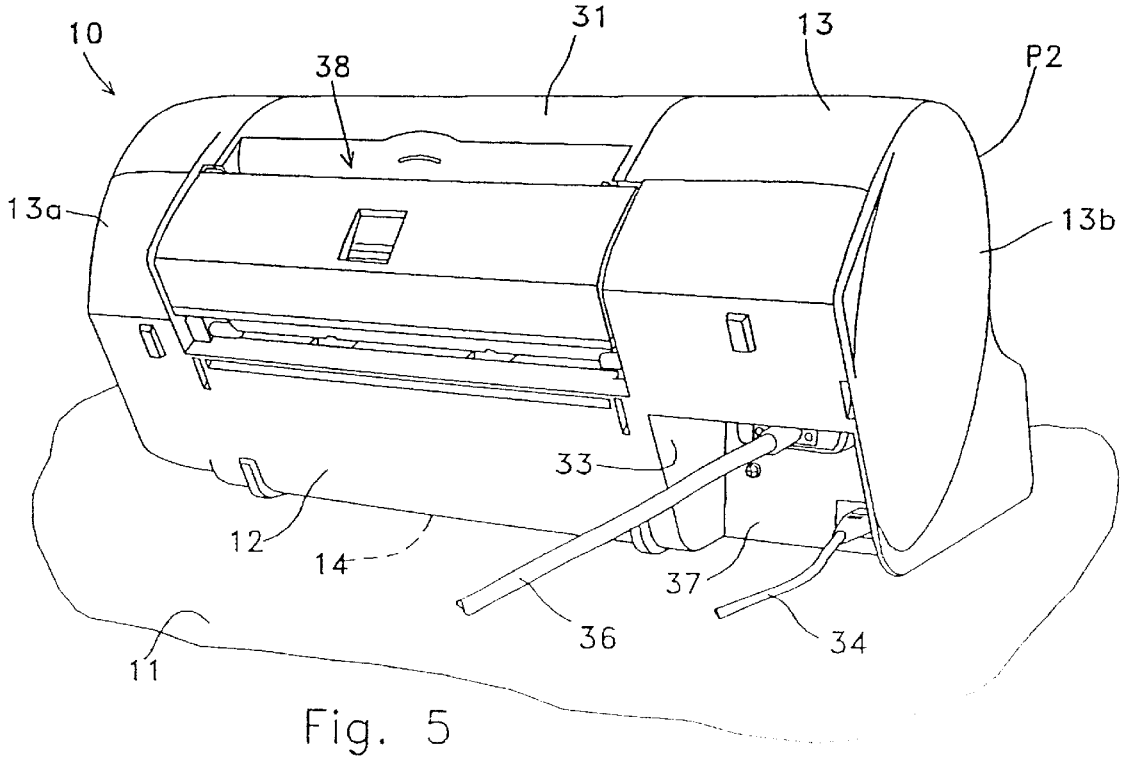
FIG. 5 is a fifth, perspective schematic view showing, from a different angle with respect to FIG. 4, the printer of FIG. 3 from the rear, in the second, horizontal working position.

The same printer 10, when it is in the second, horizontal working position P2, as depicted in FIGS. 3, 4 and 5, is instead set on the plane 11 on the second side 14. Similarly to FIG. 1, FIG. 3 represents the printer 10 roughly as it is seen by its user, in the second, horizontal working position P2.

In particular, in the horizontal working position P2, the feeding lectern 44 and the collecting lectern 46 are facing the operator, arranged substantially parallel to the support plane 11 and with the collecting lectern 46 superposed on the feeding lectern 44. In addition, the by-pass slot 38 is at the top, namely in the zone that constitutes the summit of the printer 10 in its horizontal working position P2.

The keyboard 18 is to the left of the operator when the latter is facing the printer 10 and is also oriented, with respect to the support plane 11, with an inclination substantially similar to that assumed by the keyboard 18, when the printer 10 is in the vertical working position P1.

In the positions P1 and P2 the side 12 and, respectively, the side 14 are in direct contact with the support plane 11, so as to define a support base for the printer 10 thereby guaranteeing a certain stability in both these working positions. To this end, the masses of the printer 10 are distributed inside the latter in such a way that its centre of gravity lies inside the support base, both in the vertical working position P1 and in the horizontal one P2.

The way of using the printer 10 of this invention is as follows. To begin with, the printer 10 is placed by the user on the support plane 11 according to either of its working positions P1 or P2 cited above. For example, where the user has selected the vertical working position P1, the printer 10 will be seen by the user roughly as illustrated in FIG. 1. At this point, the user, after loading the ream 22 of blank sheets into the feeding tray 21 from the top, activates the printer 10 so that the sheets are taken from the tray 21, printed and finally ejected to the collecting tray 29, where they are disposed inclined upwards, ready to be taken by the user.

Naturally, to begin with, the user can also choose to place the printer 10 in the horizontal working position P2, in which case it will be seen by the user roughly as illustrated in FIG. 3. Subsequently the user effects the same operations as already examined for the vertical position P1, with the sole difference that the ream 22 of blank sheets must be loaded into feeding tray 21 in the horizontal direction, and the printed sheets taken from the collecting tray 29 again horizontally.

It is stressed that the typical functions of the printer 10, that is to say the feeding of the blank sheets loaded by the user in the tray 21, their printing, and finally their ejection to the tray 29, are not in the slightest way altered by the fact that the printer 10 is placed in one working position rather than the other.

The user can even change, during the course of normal work the working position of the printer 10 with the greatest of ease, simply by throwing the printer 10 back with respect to the horizontal plane 11, pivoting it on the edge 15, in order to change the side of the printer 10 that is sitting on the horizontal plane 11, and then by obviously rotating the printer 10 thus thrown back so that it faces the user correctly.

It remains understood that changes and/or improvements may be made to the printer with two working positions, without departing from the scope of this invention.

What we claim is:

1. A printer adapted for being selectively arranged on a substantially horizontal support plane either in a vertical working position or in a horizontal working position in order to operate for printing sheets in both the said working positions, said printer comprising an external casing with a first side and a second side which have a common edge free of protrusions and which together define an obtuse angle, wherein the various parts of said printer have masses which are distributed in such a way that the center of gravity of said printer lies inside said first side and inside said second side, respectively when said printer is placed in said vertical working position with said first side set directly on said horizontal plane, and when said printer is placed in said horizontal working position with said second side set directly on said horizontal plane, thereby guaranteeing the stability of said printer in both said positions, whereby said printer can be moved from said vertical position to said horizontal position, and vice versa, by rotating said printer on said horizontal plane around said common edge shared by said first and said second side of said external casing.

2. The printer according to claim 1, wherein said angle is between 95° and 155°.

3. The printer according to claim 2, wherein said angle is between 115° and 135°, and preferably about 125°.

4. The printer according to claim 1, further comprising a feeding tray and a collecting tray, a printing path between said feeding tray and said collecting tray, and a print head arranged along said printing path, said feeding tray being adapted for feeding one sheet at a time to said printing path from a ream of sheets deposited in said feeding tray, and said collecting tray being in turn adapted for receiving said sheets one at a time after they have been printed by said print head, wherein said feeding tray and said collecting tray are disposed side by side facing each other and furthermore extend substantially parallel to said second side, so that when said printer is in said first vertical working position, said feeding tray and said collecting tray are oriented at an acute angle to said horizontal plane and, when said printer is in said horizontal working position, said trays are substantially parallel to said horizontal plane.

5. The printer according to claim 4, wherein said feeding tray is disposed adjacent to said second side, and said collecting tray is disposed at a greater distance from said second side, whereby said feeding tray is disposed under said collecting tray, when said printer is in said horizontal working position.

6. The printer according to claim 5, wherein said feeding tray and said collecting tray each comprise a respective removable lectern for supporting said sheets over their surface area, in which in particular the lectern of said collecting tray is disposed so that the sheets printed and resting thereon are facing towards the user of said printer.

7. Printer according to claim 4, having an auxiliary slot made in said collecting tray between the respective lectern and a fixed bottom of said collecting tray, said auxiliary slot being usable for feeding manually and directly, through the same, one or more sheets to said printing path, without having to load them first in said feeding tray.

8. Printer according to claim 1, further comprising a connector in which at least one external cable can be inserted so as to connect electrically said printer with the outside, and a recess in which said connector is housed, said recess being provided for accommodating an end portion of said cable, when inserted in said connector, and being formed externally by said casing along said edge so as to extend on the one hand along said first side and on the other along said second side, whereby said end portion freely accesses said connector along said support plane both in said vertical working position and in said horizontal working position of said printer, without ever coming between said horizontal plane and said sides.

9. The printer according to claim 1, further having a printing path, and an external slot to permit the manual feeding of single sheets to said printing path, wherein said external slot is disposed along the outer surface of said casing adjacent to said first side.

10. The printer according to claim 1, comprising a keyboard for the control of said printer, in which said keyboard is arranged to the side of said collecting tray along a surface formed by said casing, said surface being such as to present, both in the vertical working position and in the horizontal working position of said printer, a substantially identical inclination with respect to said horizontal plane, so that said keyboard is easily manipulated in both said positions.

11. The printer according to claim 1, wherein said printer is of the ink jet type, and comprises a print head suitable for working according to the ink jet printing technology.

* * * * *